US008251721B2

(12) United States Patent
Ikeda et al.

(10) Patent No.: US 8,251,721 B2
(45) Date of Patent: Aug. 28, 2012

(54) ACTIVE CONNECTOR

(75) Inventors: Yasunari Ikeda, Kamakura (JP); Kimio Kawamoto, Tokyo (JP)

(73) Assignee: Canare Electric Co., Ltd, Aichi (JP)

( * ) Notice: Subject to any disclaimer, the term of this patent is extended or adjusted under 35 U.S.C. 154(b) by 96 days.

(21) Appl. No.: 12/861,108

(22) Filed: Aug. 23, 2010

(65) Prior Publication Data

US 2012/0045936 A1 Feb. 23, 2012

(51) Int. Cl.
*H01R 29/00* (2006.01)

(52) U.S. Cl. ..... 439/188; 439/620.07

(58) Field of Classification Search ..... 439/620, 439/188

See application file for complete search history.

(56) References Cited

U.S. PATENT DOCUMENTS

| | | | | |
|---|---|---|---|---|
| 5,947,752 | A * | 9/1999 | Wu | 439/76.1 |
| 6,290,508 | B1 * | 9/2001 | Wu | 439/76.1 |
| 6,974,265 | B2 * | 12/2005 | Chiu et al. | 385/92 |
| 7,285,024 | B1 * | 10/2007 | Tai | 439/668 |

FOREIGN PATENT DOCUMENTS

| | | | |
|---|---|---|---|
| JP | 61-8863 | A | 1/1986 |
| JP | 4-255681 | A | 9/1992 |
| JP | 2005-285043 | A | 10/2005 |
| JP | 2007-258125 | A | 10/2007 |
| JP | 2010-102910 | A | 5/2010 |

* cited by examiner

*Primary Examiner* — Truc Nguyen

(74) *Attorney, Agent, or Firm* — Birch, Stewart, Kolasch & Birch, LLP.

(57) ABSTRACT

An active connector is provided that allows for simple designing of devices for high-speed wideband pulse signal transmission without specialized technical know-how in the use of connectors. A connector base has a first connection terminal and a second connection terminal, and houses a first matching circuit, a second matching circuit, and a buffer circuit. The first connection terminal and the second connection terminal can be used as an internal port electrically coupled to a device circuit and an external port electrically coupled to a transmission line, respectively. An input signal inputted into the first connection terminal is supplied to the first matching circuit. The second matching circuit supplies an output signal to the second connection terminal. A buffer circuit between the first matching circuit and the second matching circuit inhibits mutual influences between the input signal and the output signal.

10 Claims, 10 Drawing Sheets

ACTIVE CONNECTOR

BACKGROUND OF THE INVENTION

Signals are transmitted between devices, which send or receive signals, and transmission lines via a connector provided at either the output end or the input end of a device. In most of these types of signal transmission methods, a physical interface is previously prescribed as a standard. Representative physical interfaces are applicable to connector mechanical structures and dimensions, signal amplitude, impedance, frequency characteristics, loss, and the like.

Recently, along with the development of the application of broadcasting technology using High Definition Television (HDTV) signals, there has been an increase in examples in which high-speed and wideband pulse signal strings are transmitted between devices and transmission lines. When transmitting these types of high-speed and wideband pulse signal strings, it is important to pay close attention to electrical characteristics such as frequency characteristics, signal levels, and even return loss.

In the past, connectors were used to try to improve frequency and reflection characteristics by making the connector itself a four-terminal circuit network to try to avoid degradation of the signals as they passed through the connector acting as a passive component connecting circuits inside a device and a transmission line.

However, since a connector is basically a passive circuit, when signals are transmitted to the transmission line, the connector is electrically affected by the driver circuits inside the device. On the other hand, when the connector receives signals from the transmission line, the connector is electrically affected by the circuit inside the device acting as a connector load. Also, the connector may be affected by another transmission line (internal wiring) connected between the connector and a circuit inside the device.

In this way, even if the characteristics of the connector itself as a four-terminal circuit network are suitable, the connector is electrically affected by the transmission line and the circuits inside the device to which the connector is joined. Thus, the connector must also be considered when designing the inside of the device. However, high-speed and wideband pulse signals are sensitive to the effects of parasitic elements and so the design of the inside of the device must take into account technical know-how on component mounting, circuit pattern, and the like. Therefore, the performance of the device depends upon the designer and may vary greatly regardless of whether the device is designed and assembled according to the same circuit drawings.

An active connector with an active circuit such as an amplifier provided inside the connector is disclosed for example in Japanese Unexamined Patent Application Publication No. 2007-258125. However, the aforementioned document does not disclose that the active connector avoids mutual influences between input and output signals thereof designed to be connected between circuit boards.

SUMMARY OF THE INVENTION

As described above, impedance characteristics and transmission characteristics on the input side and output side of connectors of the prior art are affected by the circuits (including transmission lines) to which they are electrically connected on the input side and the output side. Thus, even though the performance of the connector itself may be improved, the performance of the overall system may not necessarily be improved due to the effect of external circuits.

Therefore, even though a designer carefully considers the mutual influences of the circuits at input side and output side of the connector in order to meet high requirements or improve the performance of the device when, for example, designing devices for high-speed and wideband pulse signal transmission, component mounting, circuit pattern, and the like need to be carefully designed and thus specialized design know-how is required.

Thus, it is an object of the present invention to provide an active connector in which specialized technical know-how in the use of connectors may be no longer needed when designing devices for high-speed and wideband pulse signal transmission.

Also, it is an object of the present invention to provide an active connector in which a designer can easily obtain consistent, stable, and high performance characteristics based on a simple design.

According to one aspect of the present invention, there is provided an active connector that is applied at the output end or the input end of a device that sends or receives signals. The active connector includes a connector base that has a first connection terminal and a second connection terminal, a first matching circuit supplied with an input signal inputted from the first connection terminal, a second matching circuit that supplies an output signal to the second connection terminal, and a buffer circuit provided between the first matching circuit and the second matching circuit to inhibit mutual influences between the input signal and the output signal. The first matching circuit, the second matching circuit, and the buffer circuit are housed in the connector base.

According to one embodiment of an active connector in the present invention, the first connection terminal is an internal port electrically coupled to a circuit inside a device, and the second connection terminal is an external port electrically coupled to a transmission line.

According to a preferred embodiment of an active connector in the present invention, the buffer circuit may output an output signal in which at least one of signal amplitude and a signal type of the input signal supplied by the first connection terminal is converted, and also may drive the transmission line electrically coupled to the second connection terminal.

According to a preferred embodiment of an active connector in the present invention, a filter circuit that has a frequency characteristic may be further included. The filter circuit may be placed in the connector base.

Also, according to a preferred embodiment of an active connector in the present invention, the buffer circuit may be configured to be able to switch to at least one of different operating characteristics and different operating states. The buffer circuit may have a control terminal to activate the switching.

Also, according to a preferred embodiment of an active connector in the present invention, a signal from detection means that detect whether or not the input signal is supplied to the first connection terminal is input to the control terminal, and when the input signal is not supplied, an active element in the buffer circuit may be switched to a dormant state.

Furthermore, according to a preferred embodiment of an active connector in the present invention, a parallel-serial conversion circuit may be further provided to convert a parallel signal supplied as the input signal into a serial signal. The parallel-serial conversion circuit may be placed in the connector base.

According to one embodiment of an active connector in the present invention, the first connection terminal is an external port electrically coupled to a transmission line, and the second connection terminal is an internal port electrically coupled to a circuit inside a device.

According to a preferred embodiment of an active connector in the present invention, the buffer circuit may convert at least one of the signal amplitude and the signal type of the input signal supplied from the first connection terminal.

Also, according to a preferred embodiment of an active connector in the present invention, an equalizing circuit may be further provided that corrects at least one of a frequency characteristic and a loss characteristic of the transmission line. The equalizing circuit may be placed in the connector base.

Furthermore, according to a preferred embodiment of an active connector in the present invention, the buffer circuit may further include a discrimination circuit that determines whether a logic level of the input signal is "1" or "0" by comparing the input signal to a predetermined threshold.

Also, according to a preferred embodiment of an active connector in the present invention, a clock recovery circuit may be further provided that recovers the timing of the input signal and reclocks the input signal with an optimum timing of each time slot. The clock recovery circuit may be placed in the connector base.

Also, according to a preferred embodiment of an active connector in the present invention, the connector base may further include a clock recovery circuit that recovers the timing of the input signal and reclocks the input signal with an optimum timing of each time slot, and a serial-parallel conversion circuit that, after the reclocking, converts the serial signal to a parallel signal. The clock recovery circuit and the serial-parallel conversion circuit may be placed in the connector base.

The active connector according to the present embodiment includes a buffer circuit provided between a first matching circuit and a second matching circuit. The buffer circuit inhibits mutual influences between the input signal and the output signal and is provided in a connector base. Therefore a connector may be provided that contributes to the efficient circuit design of devices with improved performance since a designer no longer needs to use specific technical know-how and the burden on circuit design is greatly reduced.

According to a preferred embodiment of the present invention, since the buffer circuit outputs an output signal into which the signal amplitude and/or the signal type of the input signal supplied from the first connection terminal is converted and the output signal activates the transmission line electrically coupled to the second connection terminal, a connector can be designed that can obtain a desired waveform and/or amplitude of an output signal in response to the signal type and/or amplitude (level) of the input signal.

According to one embodiment of the present invention, since a filter circuit having a frequency characteristic is also provided in the connector base, the connector is able to conduct pre-equalization of transmission signals, suppression of unintentional emissions, and the like.

According to a preferred embodiment of the present invention, since the buffer circuit is configured to be able to switch to different operating characteristics and/or different operating states and has a control terminal to activate the switching, it is possible to change frequency characteristics and/or change active connector operating states through the control terminal.

According to a preferred embodiment of the present invention, a signal from detecting means that detects whether or not an input signal is supplied to a first connection terminal is inputted to a control terminal, an active element that the buffer circuit has is switched to a dormant state if the input signal is not supplied. When this occurs, electrical power consumption can be suppressed when the input signal to be supplied from the device to the transmission line is not inputted.

According to a preferred embodiment of the present invention, since a parallel-serial conversion circuit that converts parallel signals supplied as input signals into serial signals is provided in a connector base, the burden on circuit design for the designer is greatly reduced because the designer of the device does not need to deal directly with high-speed signals on the circuit board inside the device.

According to a preferred embodiment of the present invention, since an equalizing circuit that corrects at least one of a frequency characteristic and a loss characteristic of a transmission line is provided in a connector base, the burden on circuit design for designers is greatly reduced because specialized technical know-how for designing component mounting and circuit pattern including the influence of frequency characteristics of signal transmission over a relatively long transmission line becomes unnecessary.

According to a preferred embodiment of the present invention, since the buffer circuit includes a discrimination circuit that discriminates whether a logic level of an input signal is "1" or "0" in comparison to a predetermined threshold, a correct signal can be transmitted from the input side even when there is a possibility of an incorrect detection of the data logic level due to a degraded input signal waveform because the circuit inside the device can be activated after such recovery of the data.

According to a preferred embodiment of the present invention, since a clock recovery circuit that recovers the input signal timing and reclocks the input signal with an optimum timing for each time slot is further provided in the connector base, incorrect signal reception at the device side can be reduced because a signal at the timing position with the largest signal-to-noise power ratio can be identified beforehand in the connector.

According to a preferred embodiment of the present invention, since the connector base further includes a clock recovery circuit that recovers the input signal timing and reclocks the input signal with an optimum timing for each time slot, and a serial-parallel conversion circuit that converts a serial signal to a parallel signal after the reclocking, on top of the capability of reducing incorrect signal reception on the device side, the burden on circuit design for the designer who designs the device is greatly reduced because there is no need to deal directly with high-speed signals on the circuit board in the device.

The present invention may be widely applicable to an input end or an output end of a device that provides signal transmission between an external transmission line and a circuit inside a device or between a transmission line inside a device and an external circuit.

The above objectives and advantages of the present invention, as well as other objectives and advantages will become apparent through the description of the following embodiments. Furthermore, it is to be noted that the following embodiments are merely examples, and the present invention is not limited as such.

DESCRIPTION OF THE PREFERRED EMBODIMENTS

Preferred embodiments of the active connector according to the present invention are explained in detail based on the drawings.

Figure 1:
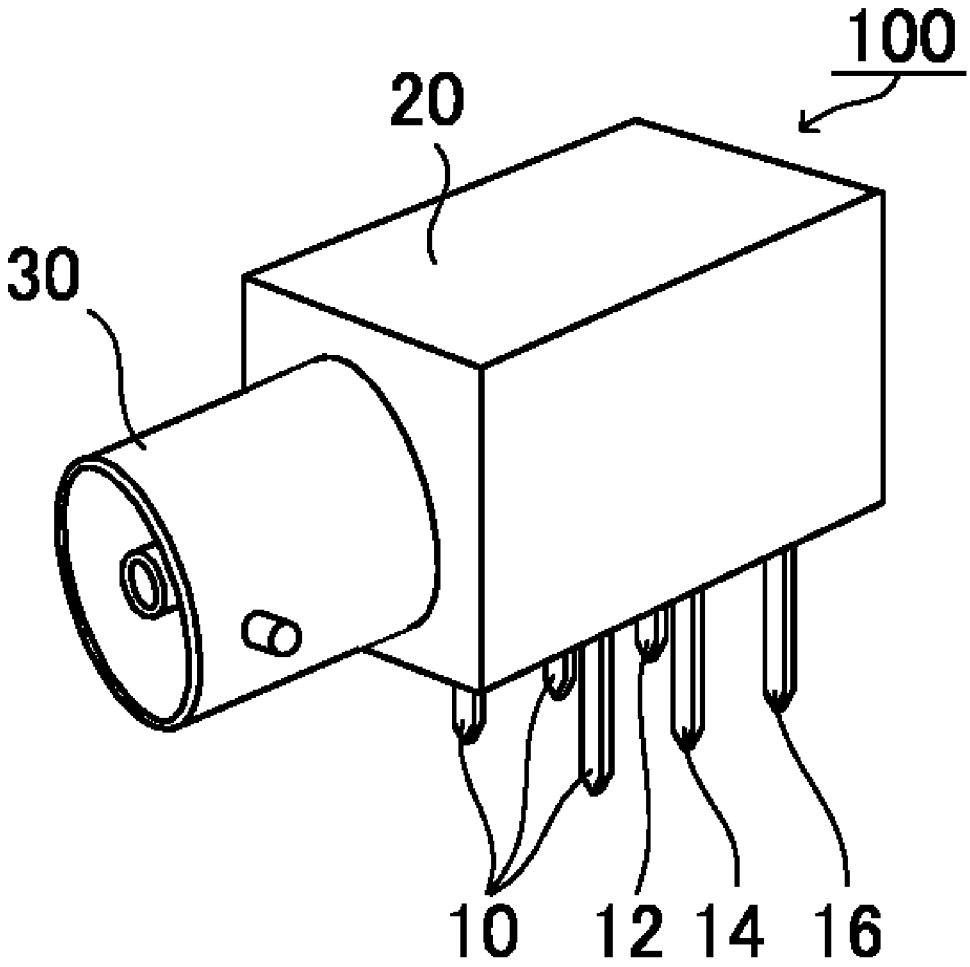
FIG. 1 is a perspective view of an example of an active connector according to the present invention.
Figure 2:
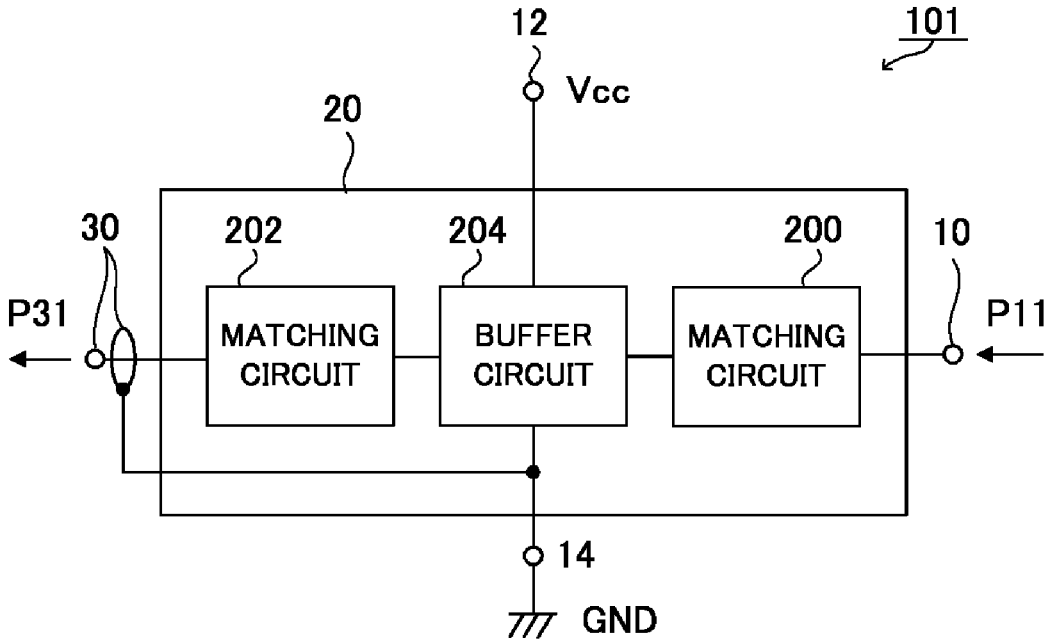
FIG. 2 is a block diagram of an example of a basic configuration of a first embodiment of the active connector according to the present invention.

FIG. 1 is a perspective view of an example of an active connector according to the present invention. FIG. 2 is a block diagram of an example of a basic configuration according to a first embodiment of the active connector. The active connector according to the present embodiment has a connector base to be mounted on a board (not shown) and input and output connection terminals. One of the connection terminals is a type of electrical connector that becomes an output terminal or an input terminal provided in a housing panel of a device (not shown). Specifically, one of the connection terminals is applicable to a BNC type connector (heretofore called a "BNC connector") for electrically coupling a 50Ω or 75Ω coaxial cable as a transmission line to a device.

An active connector 100 has connector terminals 10, a connector base 20, and a connector terminal 30. The connector terminals 10 are formed by a plurality of pins that protrude from the bottom of the connector base 20, and are electrically connected to a circuit on a board (also not shown) provided inside a device. The active connector 100 also has a power supply terminal 12 for electrical power connection, a GND terminal 14, and a control terminal 16, which will be described later. The power supply terminal 12, the GND terminal 14, and the control terminal 16 are also formed as pins that protrude from the bottom of the connector base 20.

On the other hand, the connector terminal 30 is a BNC jack or a BNC receptacle protruding from one side of the connector base 20. In other words, the connector terminal 30 functions as an output end or as an input end that is provided on a casing, for example a back panel, of a device (not shown), and is formed in such a manner that a BNC plug that is electrically connected to an end of a coaxial cable transmission line (not shown) can be attached to and detached from the connector terminal 30. In the following explanations, the connector terminals 10 may be referred to as an internal port, and the connector terminal 30 may be referred to as an external port for the sake of convenience.

Referring to FIG. 2, the connector base 20 of an active connector 101 according to the first embodiment houses a matching circuit 200 on the internal port side, a matching circuit 202 on the external port side, and a buffer circuit 204. The matching circuit 200 is connected to an internal port 10 and receives an input signal P11 from a circuit inside the device (not shown). On the other hand, the matching circuit 202 supplies an output signal P31 to an external port 30. The buffer circuit 204 is provided between the matching circuit 200 and the matching circuit 202 and has the function of inhibiting mutual influences of the input signal P11 and the output signal P31. Also, the buffer circuit 204 may include at least one active element that is driven by direct-current voltage Vcc from a power source (not shown), the direct-current voltage Vcc being supplied to the power supply terminal 12.

According to the active connector configured as described above, the mutual influences between the input signal and the output signal are inhibited by the buffer circuit 204 provided in the connector base 20. Therefore, when designing transmission of signals from a device to a coaxial cable transmission line, one may consider the transmission of a signal from the signal source to the internal port 10 and the transmission of a signal outputted from the external port 30 separately.

When using a conventional connectors, specialized technical know-how is necessary to design components mounting and circuit pattern by further considering the mutual influences caused by coaxial cable connected to the external port as opposed to the active connector of the present invention. In other words, impedance and transfer characteristics of the input side and those of the output side of the conventional connectors are affected by circuits (including transmission lines) coupled to the input side and the output side. So even if the performance of the connector itself is improved, high performance characteristics are not necessarily obtained for the whole system due to the effects of these external circuits. In contrast, since specialized technical know-how is unnecessary and the burden on circuit design is greatly reduced for the designer, the connector according to the present invention can contribute to efficient circuit design of devices with improved performance.

Since two sections can be designed separately as described above, both the matching circuit 200 on the internal port side and the matching circuit 202 on the external port side can have simple configurations. Also, the buffer circuit 204 is beneficial since the buffer circuit 204 can be designed to address the signal type (differential signal, single end signal types, etc.) and amplitude (level) of the input signal P11 so that a desired waveform or amplitude of the output signal P31 can be obtained. Thus, for example a correct signal compensated for loss in the connector can be sent to a coaxial cable.

Figure 3:
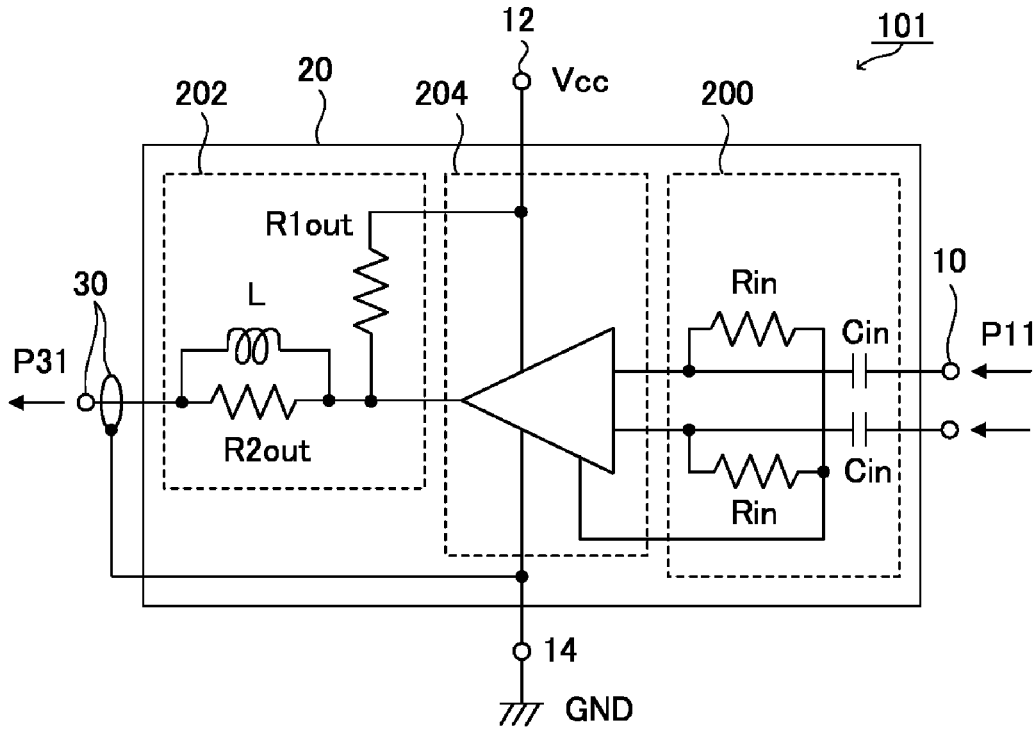
FIG. 3 is a circuit diagram of the example of the active connector illustrated in FIG. 2.

FIG. 3 is a circuit diagram of the example of the active connector 101 illustrated in FIG. 2. The following describes an example of sending a High Definition Serial Digital Interface (HD-SDI) signal that is a bit serial signal sequence of uncompressed HDTV signal to a transmission line (coaxial cable) from a device. Normally, a HD-SDI signal is a differential signal and a microstrip line (not shown) with impedance characteristics of 50Ω or 75Ω is used to supply the HD-SDI signal from a circuit inside the device to the connector internal port 10.

When the matching circuit 200 in the connector base 20 of the active connector 101 receives input signal P11 of this differential type at the internal port P10, the microstrip line impedance is matched. Often, two lines are terminated with terminal resistors Rin as illustrated in FIG. 3. When, being affected by a parasitic element, it is necessary to improve the matching state in a high frequency region, further adding a specific circuit to cancel the effect of the parasitic element can improve the characteristics. For example, the electric power load of a driver circuit (not shown) increases if the HD-SDI signal has a direct-current component upon receiving the HD-SDI signal. As illustrated in the example in FIG. 3, each line of the matching circuit 200 is serially connected to a capacitor Cin so that the matching circuit 200 is configured to block direct-current components. Direct-current voltage is supplied to the matching circuit 200 from the buffer circuit 204 in order to have an appropriate bias applied to the input side of the buffer circuit 204.

The input signal supplied to the buffer circuit 204 is converted to an output signal adjusted to a specific amplitude, and then inputted to the matching circuit 202. The signal is then supplied from the matching circuit 202 to a coaxial cable transmission line (not shown) that is electrically connected to the external port.

A buffer circuit for HD-SDI signal transmission can be configured as a current mode logic (CML) circuit. Since a CML circuit is commonly a collector output with a high output impedance, the matching circuit 202 to which that output is inputted can have a very simple configuration. Since a CML circuit has a high output impedance, parasitic capacitance may become a problem. Therefore, as illustrated in the example in FIG. 3, the buffer circuit 204 is connected to an LR circuit, in other words a parallel circuit with an inductor L and a resistor R2out, and to a resistor R1out to cancel the parasitic capacitance and to improve the output impedance characteristics.

Figure 4:
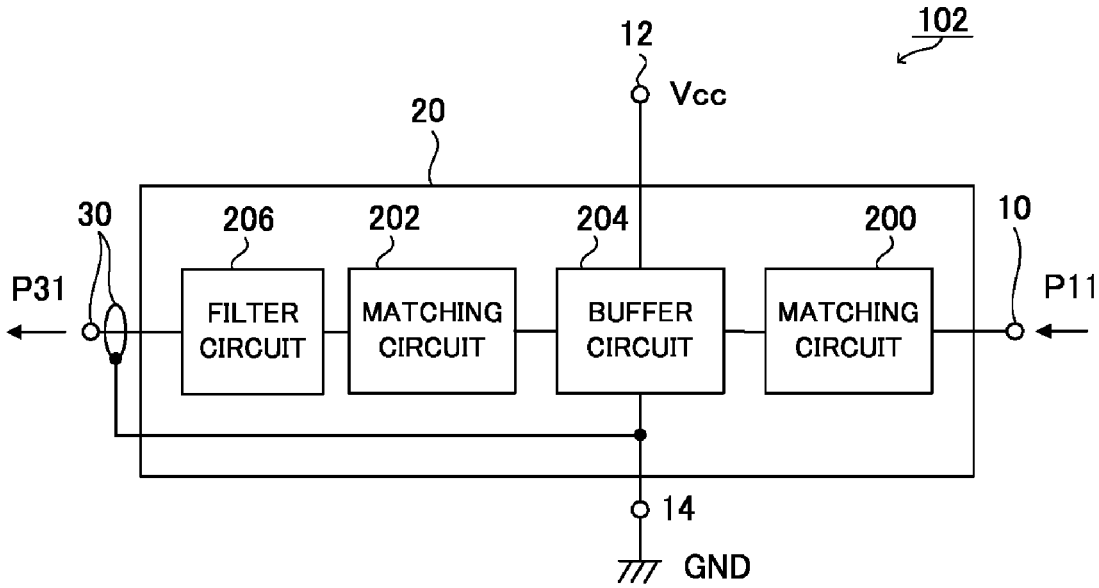
FIG. 4 is a block diagram of another example of a configuration of the first embodiment of the active connector according to the present invention.

FIG. 4 is a block diagram of another example of a configuration of the first embodiment of the active connector according to the present invention. An active connector 102 illustrated in FIG. 4 differs from the active connector 101 illustrated in FIG. 2 in that the connector base 20 in the active connector 102 further includes a filter circuit 206. The output of the buffer circuit 204 is supplied to the matching circuit 202 and then passes through the filter circuit 206 and is supplied to the external port 30 as the output signal P31. As illustrated in the example in FIG. 4, the filter circuit 206 is provided between the matching circuit 202 and the external port 30, however the filter circuit 206 may be provided between the buffer circuit 204 and the matching circuit 202. In other words, the order of the matching circuit 202 and the filter circuit 206 does not matter.

The filter circuit 206 may be designed to have various characteristics as required. For example, assuming attenuation of the high frequency region in the coaxial cable transmission line beforehand, the filter circuit 206 can have a characteristic that strengthens high frequency range components (transmission signal pre-equalization treatment). On the other hand, the filter circuit 206 can also have another characteristic that suppresses excessive high frequency components to suppress unintentional emission. By providing a filter circuit with these types of characteristics in the connector base 20, a desired output signal P31 spectrum can be obtained according to the usage.

Figure 5:
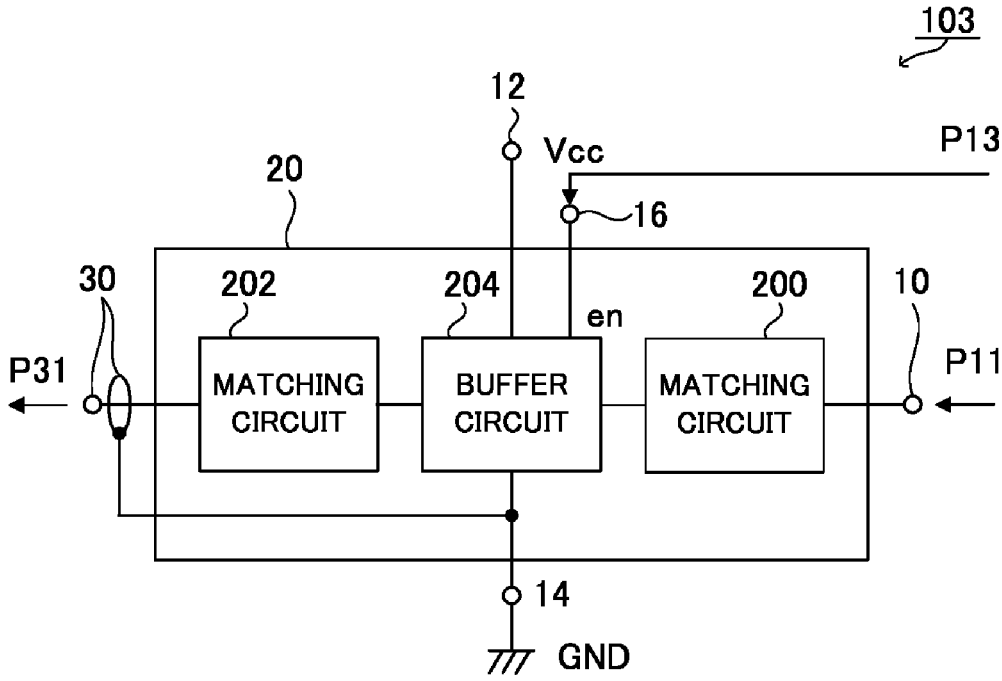
FIG. 5 is a block diagram of still another example of a configuration of the first embodiment of the active connector according to the present invention.

FIG. 5 is a block diagram of still another example of a configuration of the first embodiment of the active connector according to the present invention. An active connector 103 illustrated in FIG. 5 differs from the active connector 101 illustrated in FIG. 2 in that the buffer circuit 204 is configured to be able to switch to different operating states and/or different operating characteristics, and that the buffer circuit 204 also has a control terminal 16 on the internal port 10 side for switch activating.

As an example of a case where a buffer circuit is configured to be able to switch to a different operating state, detecting means (not shown), for example, can be additionally provided at a circuit side in a device to detect whether or not the input signal P11 has been supplied to the internal port 10. A signal P13 is supplied from the detecting means to the control terminal 16 so that when the input signal P11 is not supplied, an active element in the buffer circuit 204 can switch to a non-active state. With this type of configuration, the buffer circuit 204 can be switched to a so-called dormant state and power consumption can be suppressed in the active element when, for example, an input signal to be sent from a device to a transmission line is not inputted. To avoid signal omission, it is of course necessary to design the configuration so that the operation of the buffer circuit quickly recovers from the dormant state when an input signal P11 is supplied to the internal port 10.

On the other hand, as an example of a buffer circuit configured to be able to switch to a different operating characteristic, the buffer circuit 204 of the active connector illustrated in FIG. 4, for example, can be configured to electrically switch to include or bypass the filter circuit 206 and be configured to have a control terminal for switch activating. In other words, use or non-use of a filter can be switched by a control terminal as necessary and the frequency characteristics of the active connector can be changed.

Figure 6:
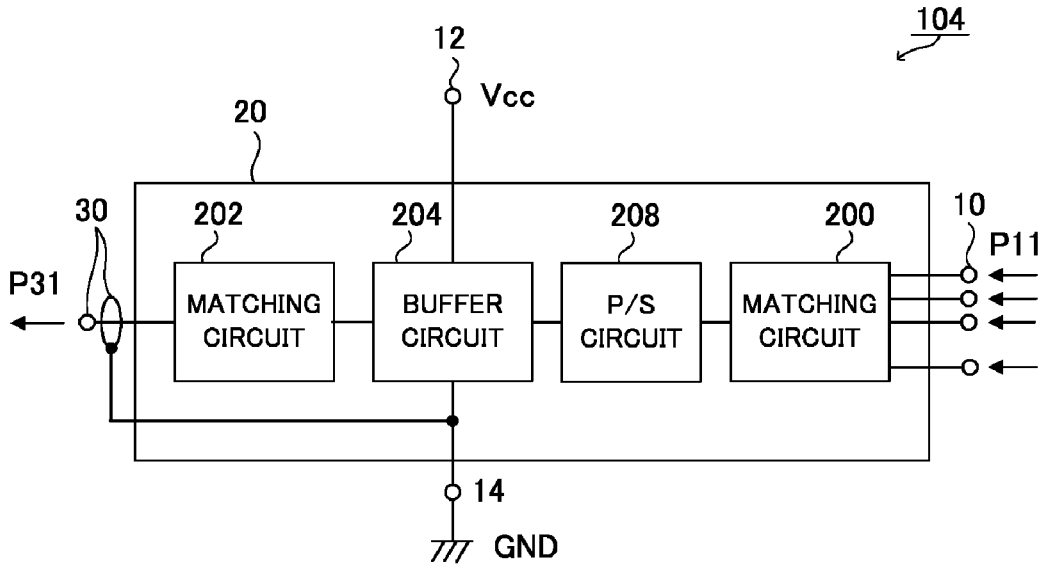
FIG. 6 is a block diagram of still another example of a configuration of the first embodiment of the active connector according to the present invention.

FIG. 6 is a block diagram of still another example of a configuration of the first embodiment of the active connector according to the present invention. An active connector 104 illustrated in FIG. 6 differs from the active connector 101 illustrated in FIG. 2 in that a parallel-serial conversion circuit (P/S circuit) 208 is further provided in the connector base 20 of the active connector 104, and that the active connector 104 has a signal rate conversion function. More specifically, when transmitting an HD-SDI signal, it is necessary to send a signal at a speed of about 1.5 Gbps from the external port 30 of the connector to the coaxial cable transmission line. However, the speed of the input signal at the input port 10 side is preferably slow since the design of circuit board inside the device is simple. Therefore, a parallel expanded, multi-bit slow bus type input signal P11, which is generated in the device, is supplied to the internal port 10 of the connector base 20. The parallel-serial conversion circuit 208 is provided after the matching circuit 200 thus allowing for rate conversion to a bit serial type signal. Then, the bit serial signal outputted from the parallel-serial conversion circuit 208 is supplied to the buffer circuit 204, the output from the buffer circuit 204 is supplied to the matching circuit 202, and the output signal P31 is supplied to the external port 30.

In this way, when the parallel-serial conversion circuit 208 is further provided in the connector base 20 and the active connector has the signal rate conversion function, the designer designing the device does not need to deal directly with high-speed signals on the circuit board in the device and so the burden on circuit design is greatly decreased.

The first embodiments described through the examples illustrated in FIG. 2 through FIG. 6 are examples of transmitter active connectors that are effective in sending signals from the device side toward the transmission line side. However, the present invention can also be applicable to receiver active connectors that are effective in sending signals from the transmission line side toward the device side. A preferred embodiment of such receiver active connector is described heretofore as a second embodiment based on the FIGS. 7 through 10.

Figure 7:
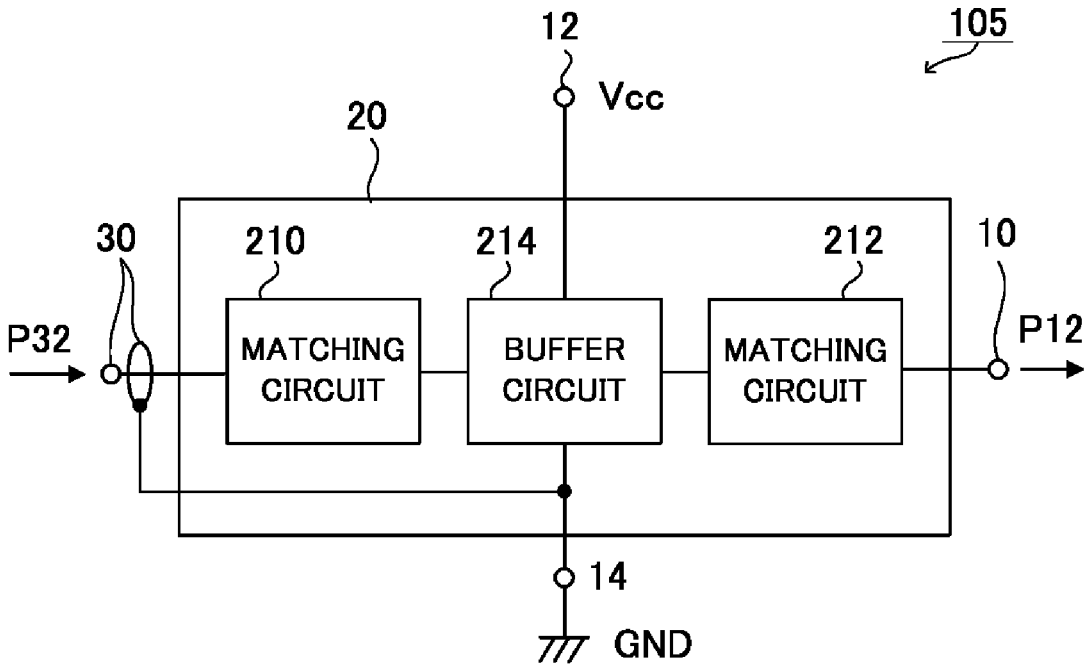
FIG. 7 is a block diagram of a basic configuration of a second embodiment of the active connector according to the present invention.

FIG. 7 is a block diagram of a basic configuration of a second embodiment of the active connector according to the present invention. A connector base 20 of an active connector 105 in the second embodiment includes a matching circuit 210 on the external port side, a matching circuit 212 on the internal port side, and a buffer circuit 214. The matching circuit 210 is supplied with an input signal P32 from a coaxial cable transmission line (not shown). On the other hand, the matching circuit 212 supplies an output signal P12 to the internal port 10. The buffer circuit 214 is provided between the matching circuit 210 and the matching circuit 212, and has the function of inhibiting mutual influences between the input signal P32 and the output signal P12.

According to the active connector configured as described above, the mutual influences between the input signal and the output signal are inhibited by the buffer circuit 214 provided in the connector base 20. Therefore, the transmission of signal from an external transmission line to the external port 30, and the transmission of signal from the internal port 10 to a circuit (receiver circuit) on a board inside the device can be considered separately when designing the transmission of signal from the coaxial cable transmission line to the device.

Therefore, according to the active connector of the second embodiment, a designer does not need to use specialized technical know-how necessary for using conventional connectors (the design know-how on component mounting and circuit pattern including the mutual influences caused by a coaxial cable connected to the external port) and the burden on circuit design is greatly reduced in a similar way to the active connector according to the first embodiment. Therefore, circuit design of improved devices can be effectively carried out.

As described above, since two sections can be designed separately according to the present embodiment, the matching circuit 210 on the external port side and the matching circuit 212 on the internal port side can both have simple configurations. Also, the buffer circuit 214 is beneficial since the buffer circuit 214 can be designed to address the signal type (differential signal, single end signal types, etc.) and amplitude (level) of the input signal P11 so that a desired amplitude of the output signal P31 can be obtained. Thus a correct signal compensated for loss in the connector can be sent to a circuit.

Figure 8:
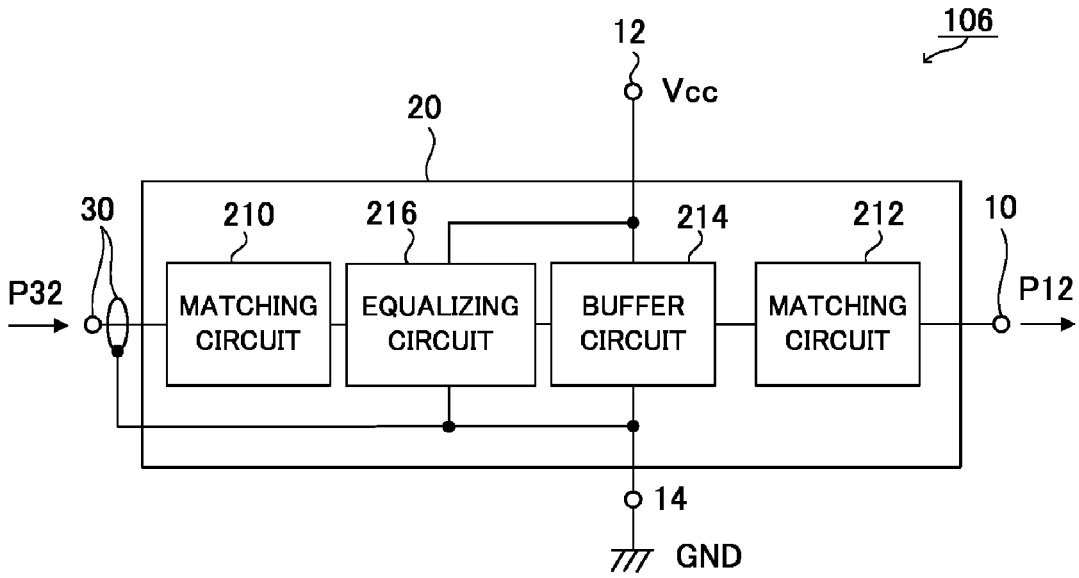
FIG. 8 is a block diagram of another example of a configuration of the second embodiment of the active connector according to the present invention.

FIG. 8 is a block diagram of another example of a configuration of the second embodiment of the active connector according to the present invention. An active connector 106 illustrated in FIG. 8 differs from the active connector 105 illustrated in FIG. 7 in that an equalizing circuit 216 to correct loss characteristics and/or frequency characteristics of the coaxial cable transmission line is further provided in the connector base 20 of the active connector 106. More specifically, as illustrated in FIG. 8, the active connector 106 is configured to supply the input signal 32, which is supplied to the external port 30 from the coaxial cable transmission line, to the matching circuit 210, then supply the signal from the matching circuit 210 to the equalizing circuit 216 and then to the buffer circuit 214, then supply the output signal P12 from the buffer circuit 214 through the matching circuit 212 to the internal port 10. The equalizing circuit 216 is driven by direct-current voltage Vcc supplied from an electrical power source (not shown) to a power supply terminal 12.

Normally, the signal supplied to the external port is transmitted over a distance of several meters or several hundreds of meters through the coaxial cable transmission line before reaching the external port. As is well known, a metal cable such as a coaxial cable has frequency characteristics in which the higher the frequency is, the greater the attenuation is. Therefore, in some cases there is a desire to remove such frequency characteristics especially at the receiving side. In particular, when transmitting HD-SDI signals that are bit serial signal sequences of uncompressed HDTV signals, in comparison to the ability to transmit stabilized accurate signals without the influence of those frequency characteristics when the transmission distance is very short, when the transmission distance passes a certain distance it is understood that the use of an equalizing circuit is necessary to correct the transmission line frequency characteristics for the receiving side equipment. Thus, in the active connector illustrated in FIG. 8, specialized technical know-how for designing component mounting and circuit pattern including the influence of frequency characteristics of signal transmission over a relatively long transmission line is unnecessary since the connector base 20 includes the equalizing circuit 216 for correcting transmission line frequency characteristics. In this way, the burden on designing circuits is greatly reduced for the designer and circuit design for devices with improved performance can be carried out effectively.

In the active connector 106 illustrated in FIG. 8, the buffer circuit 214 may further include a discrimination circuit to discriminate between a logic level "1" or "0" of the signal with the frequency characteristics corrected by the equalizing circuit 216 in comparison to a predetermined threshold. Even when there is a possibility that the waveform of an input signal supplied from the coaxial cable is degraded and an incorrect detection of the bit serial data logic level could occur if the signal is not corrected, this type of configuration is very effective for transmitting an accurate signal from the receiving side since the data of the input signal is regenerated, and then the circuit inside the device can be activated through the matching circuit 212 and the internal port 10.

Figure 9:
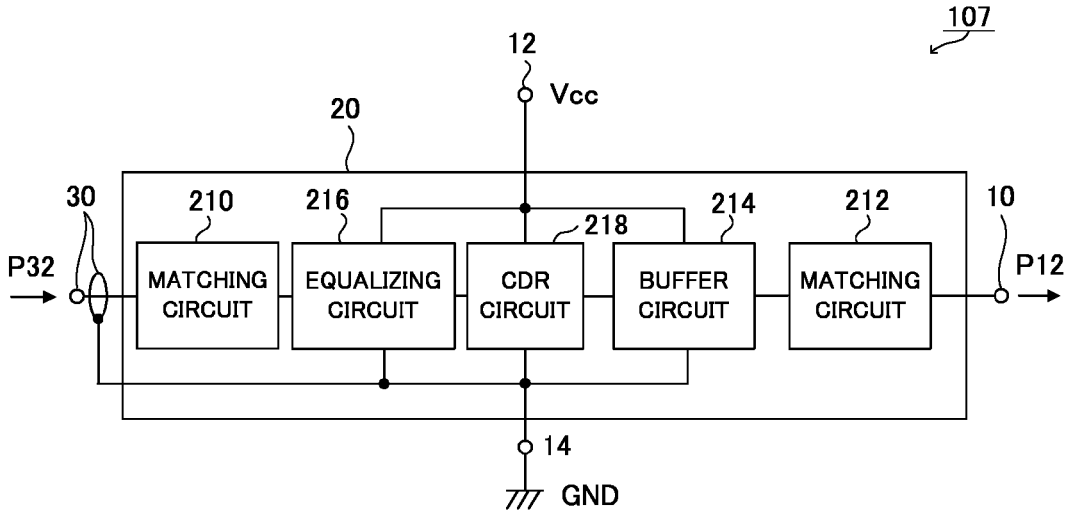
FIG. 9 is a block diagram of still another example of a configuration of the second embodiment of the active connector according to the present invention.

FIG. 9 is a block diagram of still another example of a configuration of the second embodiment of the active connector according to the present invention. An active connector 107 illustrated in FIG. 9 differs from the active connector 106 illustrated in FIG. 8 in that the connector base 20 of the active connector 107 further includes a clock recovery circuit (CDR circuit) that recovers the timing of the input signal and reclocks the signal with an optimal timing at each time slot. More specifically, as illustrated in FIG. 9, after an input signal P32 supplied from the coaxial cable transmission line to the external port 30 is supplied to the matching circuit 210, the signal from the matching circuit 210 is supplied to the equalizing circuit 216 and then to a clock recovery circuit 218. Next, the output from the clock recovery circuit 218 is supplied to the buffer circuit 214, and then the output signal P12 is supplied from the buffer circuit 214 through the matching circuit 212 to the internal port 10. The clock recovery circuit 218 is driven by direct-current voltage Vcc supplied from an electrical power source (not shown) to a power supply terminal 12.

The clock recovery circuit 218 recovers the timing for identifying the signal at a middle position of each time slot of the input signal and regenerates the logic level of the reception signal at that timing position, based on the HD-SDI input signal P32 that is a bit serial signal sequence supplied from the coaxial cable transmission line. By conducting this type of timing recovery, signal reception on the device side can have fewer errors since the signal at a timing position with the largest signal-to-noise power ratio can be identified in the connector beforehand. Also, there is an advantage in that the burden on designing circuits is greatly reduced for the designer and circuit design for devices with improved performance can be carried out effectively since jitter, which is a temporal fluctuation of the signal, can be reduced by allowing the clock recovery circuit 218 to recover the timing.

Figure 10:
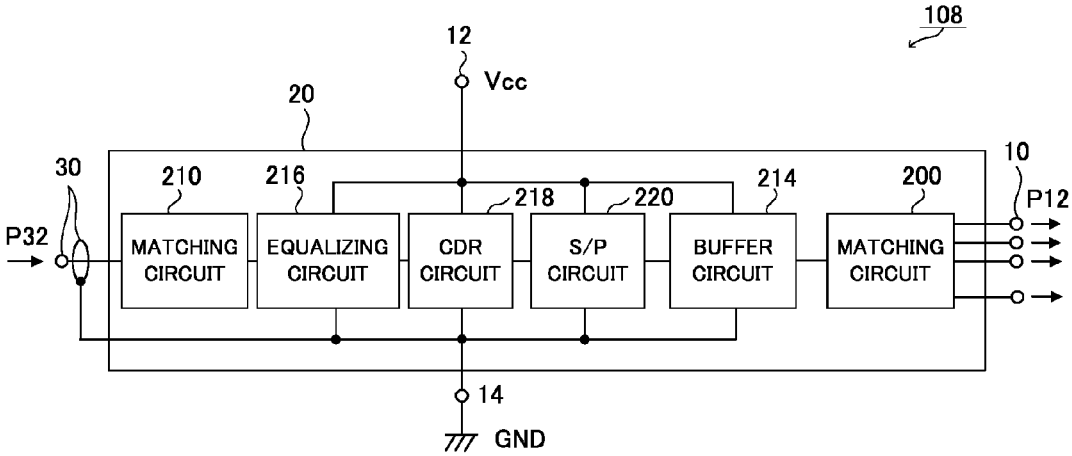
FIG. 10 is a block diagram of still another example of a configuration of the second embodiment of the active connector according to the present invention.

FIG. 10 is a block diagram of still another example of a configuration of the second embodiment of the active connector according to the present invention. An active connector 108 illustrated in FIG. 10 differs from the active connector 107 illustrated in FIG. 9 in that the connector base 20 of the active connector 108 further includes a serial-parallel conversion circuit (S/P circuit) 220 thereby providing a signal rate conversion function. In other words, in contrast to the transmitter active connector illustrated in FIG. 6, the receiver active connector illustrated in FIG. 10 includes the serial-parallel conversion circuit 220 in a stage after the clock recovery circuit 218. The serial-parallel conversion circuit 220 expands the bit serial signal to a multi-bit parallel format according to the internal circuit design of the device. The output signal P12, which has been expanded and has a reduced rate, is supplied to the internal port 10 of the connector base 20. Then, the circuit inside the device is activated by the output signal P12 outputted from the serial-parallel conversion circuit 220.

In this way, the serial-parallel conversion circuit 220 is further provided in the connector base 20 and the active connector is configured to have a signal rate conversion function. Thus, there is an advantage in that a designer of a device has a greatly reduced the burden on circuit design since dealing directly with high-speed signals on the circuit board inside the device is unnecessary.

Therefore, according to the invention, a designer does not need to use the specialized technical know-how necessary for using prior art connectors (the design know-how on component mounting and circuit pattern including mutual influences caused by a coaxial cable connected to the external port), and the burden on circuit design is greatly reduced. Therefore, there is an advantage in that circuit design of improved devices can be carried out effectively.

Regarding the embodiments described above, although examples applicable to the present invention of a BNC connector joined between a coaxial cable transmission line and a device (a transmitting device or a receiving device) have been described as a specific example compatible to a physical interface transmitting an HD-SDI signal, they are merely examples and do not limit the present invention as such. Of course, the present invention can be applicable to physical interfaces of various standards for the transmission of signals with other signal formats. In other words, the present invention is also applicable to every type of connector that is used for an input end or output end of various devices (broadcast equipment, audio and video equipment, personal computers, signal transmitter terminals, signal receiver terminals, relay equipment or repeater, etc.) that transmit using other forms of transmission lines.

As may be understood by those skilled in the art, although various embodiments of the present invention have been described herein, many other embodiments and implementations can be considered within the scope of the present invention. Therefore, with the exception of the appended claims and equivalents, the present invention is not limited.

What is claimed is:

1. An active connector applied as an output end or an input end of a device that sends or receives signals, the active connector comprising:

a connector base that has a first connection terminal and a second connection terminal, the first connection terminal being an internal port electrically coupled to a circuit inside the device, and the second connection terminal being an external port electrically coupled to a transmission line;

a first matching circuit that is supplied an input signal inputted to the first connection terminal;

a second matching circuit that supplies an output signal to the second connection terminal; and a buffer circuit that inhibits mutual influences between the input signal and the output signal, and is provided between the first matching circuit and the second matching circuit; wherein the first matching circuit, the second matching circuit, and the buffer circuit are housed in the connector base; and wherein the buffer circuit outputs an output signal in which at least one of signal amplitude and a signal type of the input signal supplied from the first connection terminal is converted, and activates the transmission line electrically coupled to the second connection terminal.

2. An active connector applied as an output end or an input end of a device that sends or receives signals, the active connector comprising:

a connector base that has a first connection terminal and a second connection terminal, the first connection terminal being an internal port electrically coupled to a circuit inside the device, and the second connection terminal being an external port electrically coupled to a transmission line;

a first matching circuit that is supplied an input signal inputted to the first connection terminal;

a second matching circuit that supplies an output signal to the second connection terminal;

a buffer circuit that inhibits mutual influences between the input signal and the output signal, and is provided between the first matching circuit and the second matching circuit; and a filter circuit that has a frequency characteristic; wherein the first matching circuit, the second matching circuit, the buffer circuit, and the filter circuit are housed in the connector base.

3. An active connector applied as an output end or an input end of a device that sends or receives signals, the active connector comprising:

a connector base that has a first connection terminal and a second connection terminal, the first connection terminal being an internal port electrically coupled to a circuit inside the device, and the second connection terminal being an external port electrically coupled to a transmission line;

a first matching circuit that is supplied an input signal inputted to the first connection terminal;

a second matching circuit that supplies an output signal to the second connection terminal; and a buffer circuit that inhibits mutual influences between the input signal and the output signal, and is provided between the first matching circuit and the second matching circuit; wherein the first matching circuit, the second matching circuit, and the buffer circuit are housed in the connector base; and wherein the buffer circuit is configured to be able to switch to at least one of different operating states and different operating characteristics, and has a control terminal to activate the switching.

4. The active connector according to claim 3, wherein a signal from detecting means that detects whether or not the input signal is supplied to the first connection terminal is inputted to the control terminal, and an active element in the buffer circuit is switched to a dormant state when the input signal is not supplied.

5. An active connector applied as an output end or an input end of a device that sends or receives signals, the active connector comprising:

a connector base that has a first connection terminal and a second connection terminal, the first connection terminal being an internal port electrically coupled to a circuit inside the device, and the second connection terminal being an external port electrically coupled to a transmission line;

a first matching circuit that is supplied an input signal inputted to the first connection terminal;

a second matching circuit that supplies an output signal to the second connection terminal;

a buffer circuit that inhibits mutual influences between the input signal and the output signal, and is provided between the first matching circuit and the second matching circuit; and a parallel-serial conversion circuit that converts a parallel signal supplied as the input signal to a serial signal; wherein the first matching circuit, the second matching circuit, the buffer circuit, and the parallel-serial conversion circuit are housed in the connector base.

6. An active connector applied as an output end or an input end of a device that sends or receives signals, the active connector comprising:

a connector base that has a first connection terminal and a second connection terminal, the first connection terminal being an external port electrically coupled to a transmission line, and the second connection terminal being an internal port electrically coupled to a circuit inside the device;

a first matching circuit that is supplied an input signal inputted to the first connection terminal;

a second matching circuit that supplies an output signal to the second connection terminal; and a buffer circuit that inhibits mutual influences between the input signal and the output signal, and is provided between the first matching circuit and the second matching circuit; wherein the first matching circuit, the second matching circuit, and the buffer circuit are housed in the connector base; and wherein the buffer circuit converts at least one of the signal amplitude and the signal type of the input signal supplied from the first connection terminal.

7. An active connector applied as an output end or an input end of a device that sends or receives signals, the active connector comprising:

a connector base that has a first connection terminal and a second connection terminal, the first connection terminal being an external port electrically coupled to a transmission line, and the second connection terminal being an internal port electrically coupled to a circuit inside the device;

a first matching circuit that is supplied an input signal inputted to the first connection terminal;

a second matching circuit that supplies an output signal to the second connection terminal;

a buffer circuit that inhibits mutual influences between the input signal and the output signal, and is provided between the first matching circuit and the second matching circuit; and an equalizing circuit for correcting at least one of a frequency characteristic and a loss characteristic of the transmission line; wherein the first matching circuit, the second matching circuit, the buffer circuit, and the equalizing circuit are housed in the connector base.

8. An active connector applied as an output end or an input end of a device that sends or receives signals, the active connector comprising:

a connector base that has a first connection terminal and a second connection terminal, the first connection terminal being an external port electrically coupled to a transmission line, and the second connection terminal being an internal port electrically coupled to a circuit inside the device;

a first matching circuit that is supplied an input signal inputted to the first connection terminal;

a second matching circuit that supplies an output signal to the second connection terminal; and a buffer circuit that inhibits mutual influences between the input signal and the output signal, and is provided between the first matching circuit and the second matching circuit; wherein the buffer circuit further includes a discrimination circuit for determining whether a logic level of the input signal is "1" or "0" in comparison to a predetermined threshold; and wherein the first matching circuit, the second matching circuit, and the buffer circuit are housed in the connector base.

9. An active connector applied as an output end or an input end of a device that sends or receives signals, the active connector comprising:

a connector base that has a first connection terminal and a second connection terminal, the first connection terminal being an external port electrically coupled to a transmission line, and the second connection terminal being an internal port electrically coupled to a circuit inside the device;

a first matching circuit that is supplied an input signal inputted to the first connection terminal;

a second matching circuit that supplies an output signal to the second connection terminal;

a buffer circuit that inhibits mutual influences between the input signal and the output signal, and is provided between the first matching circuit and the second matching circuit; and a clock recovery circuit that recovers a timing of the input signal and reclocks the input signal with an optimal timing of each time slot; wherein the first matching circuit, the second matching circuit, the buffer circuit, and the clock recovery circuit are housed in the connector base.

10. An active connector applied as an output end or an input end of a device that sends or receives signals, the active connector comprising:

a connector base that has a first connection terminal and a second connection terminal, the first connection terminal being an external port electrically coupled to a transmission line, and the second connection terminal being an internal port electrically coupled to a circuit inside the device;

a first matching circuit that is supplied an input signal inputted to the first connection terminal;

a second matching circuit that supplies an output signal to the second connection terminal;

a buffer circuit that inhibits mutual influences between the input signal and the output signal, and is provided between the first matching circuit and the second matching circuit;

a clock recovery circuit that recovers a timing of the input signal and reclocks the input signal with an optimal timing of each time slot, and a serial-parallel conversion circuit that, after the reclocking, converts a serial signal to a parallel signal;

wherein the first matching circuit, the second matching circuit, the buffer circuit, the clock recovery circuit, and the serial-parallel conversion circuit are housed in the connector base.

* * * * *